US006619000B1

(12) United States Patent
Chiu-Ying

(10) Patent No.: US 6,619,000 B1
(45) Date of Patent: Sep. 16, 2003

(54) CLAMPING DEVICE FOR COMBINED FLOORS

(76) Inventor: Lee Chiu-Ying, No. 29, Alley 51, Lane 851, Chung-Shan Rd., Shen-Kang Hsiang, Taichung Hsien (TW)

( * ) Notice: Subject to any disclaimer, the term of this patent is extended or adjusted under 35 U.S.C. 154(b) by 0 days.

(21) Appl. No.: 10/124,872

(22) Filed: Apr. 18, 2002

(51) Int. Cl.[7] ..... E04B 1/00

(52) U.S. Cl. ..... 52/127.3; 52/480; 52/590.2; 52/591.3; 52/592.1; 52/592.2; 269/291; 269/303; 269/309

(58) Field of Search ..... 52/127.1, 127.3, 52/590.2, 591.3, 592.1, 592.2, 480; 269/290, 291, 309, 303

(56) References Cited

U.S. PATENT DOCUMENTS 6,094,882 A * 8/2000 Pervan ..... 52/745.19
6,134,854 A * 10/2000 Stanchfield ..... 52/480
6,182,410 B1 * 2/2001 Pervan ..... 52/403.1

* cited by examiner

*Primary Examiner*—Carl D. Friedman
*Assistant Examiner*—Yvonne M. Horton
(74) *Attorney, Agent, or Firm*—Connolly Bove Lodge & Hutz LLP

(57) ABSTRACT

A clamping device for combined floors includes a base member having a snapper, a first rib and a second rib extending upwardly form the base member and adapted to be received in the combined floors for connecting the combined floors. The base member has a π-shaped bracket extending from a first end of the base member and a T-shaped space defined in a second end of the base member. The π-shaped bracket is reciprocally and movably received in the T-shaped space of an adjacent base member so that the clamping device is connected to one another.

3 Claims, 3 Drawing Sheets

CLAMPING DEVICE FOR COMBINED FLOORS

BACKGROUND OF THE INVENTION

1. Field of the Invention

The present invention relates to a clamping device, and more particularly to a clamping device for combined floor.

2. Description of Related Art

In the decoration of the floor, to pave the floor with a carpet, to pave the floor with plastic bricks and combined floors are the popular ways. However, the carpet is hard to keep clean and the plastic bricks are easy to be worn and torn. Consequently, to pave the floor with the combined floors is the most popular way in the decoration of the floor and the combined floor is usually wooden.

To pave the conventional wooden bricks on the original floor needs to nail a base member on the original floor and the combined floors are glued on the base member. Such a building way takes a lot of time and is short of effect. Furthermore, the convention base member provides no space to absorb the transfiguration of the combined floors because the combined floors expand when hot and shorten when cold.

The present invention has arisen to mitigate and/or obviate the disadvantages of the conventional base member of combined floors.

SUMMARY OF THE INVENTION

The main objective of the present invention is to provide a clamping device for combined floors.

To achieve the objective, the clamping device for combined floors in accordance with the present invention includes a base member having a snapper, a first rib and a second rib extending upwardly form the base member and adapted to be received in the combined floors for connecting the combined floors. The base member has a π-shaped bracket extending from a first end of the base member and a T-shaped space defined in a second end of the base member. The π-shaped bracket is reciprocally and movably received in the T-shaped space of an adjacent base member so that the clamping device is connected to one another.

Further benefits and advantages of the present invention will become apparent after a careful reading of the detailed description with appropriate reference to the accompanying drawings.

DETAILED DESCRIPTION OF THE INVENTION

Figure 1:
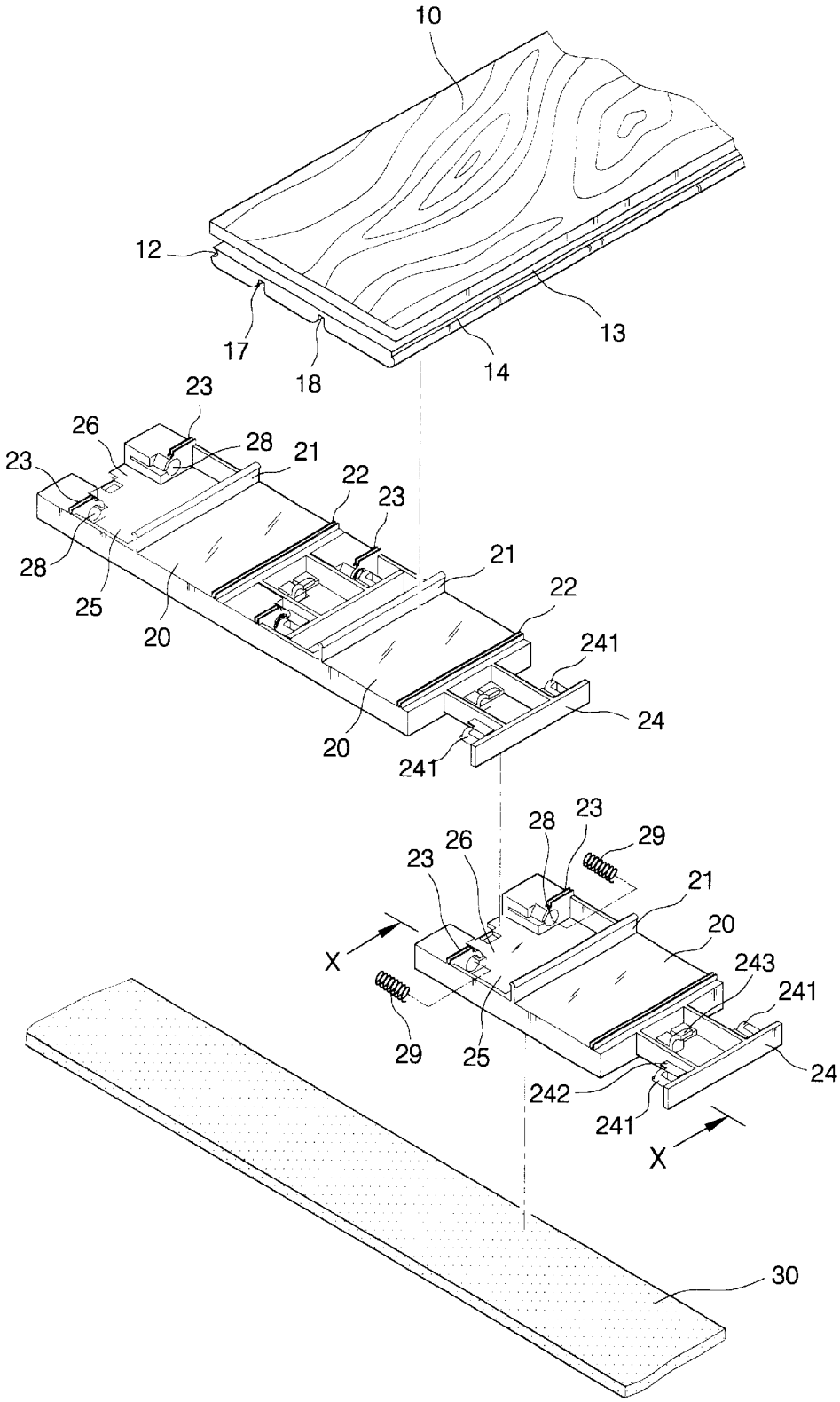
FIG. 1 is a perspective schematic view of a clamping device for combined floors in accordance with the present invention.
Figure 2:
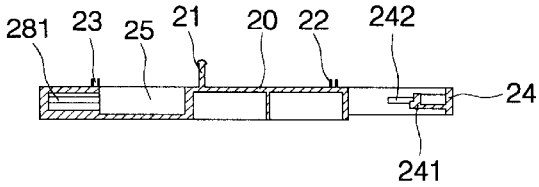
FIG. 2 is a cross sectional side plan view of the clamping device for combined floors in FIG. 1 along the line X—X.
Figure 3:
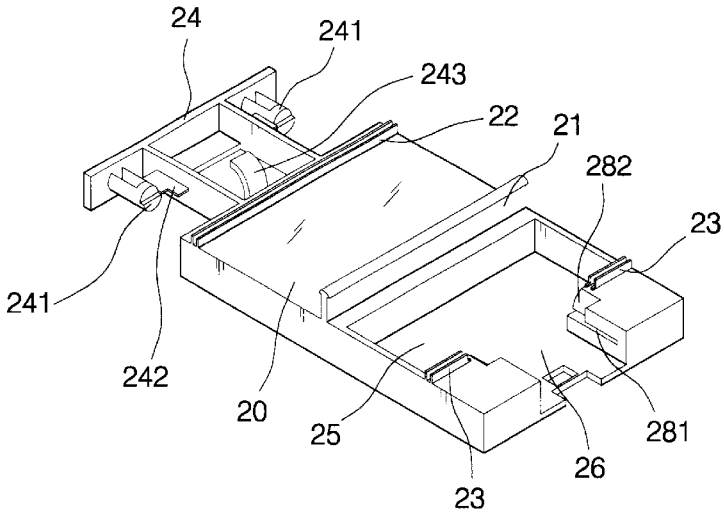
FIG. 3 is a perspective view of the clamping device for combined floor in FIG. 1.
Figure 4:
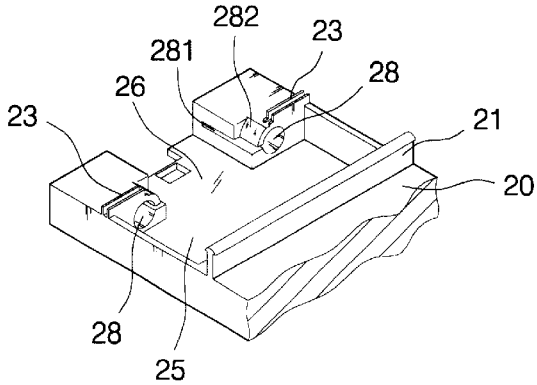
FIG. 4 is a partially perspective view of the clamping device for combined floor in FIG. 1.

With reference to the drawings and initially to FIGS. 1–4 and 6, the present invention is a clamping device for combined floors.

Each of the combined floors has a rectangular body (10). A protrusion (11) is longitudinally and laterally extending from a first side of the body (10) and a connecting groove (13) is longitudinally and laterally defined in a second side of the body (10), wherein the first side and the second side of the body (10) are opposite to each other. A first groove (12) is longitudinally and laterally defined in the first side of the body (10) under the protrusion (11). A second groove (14) is longitudinally and laterally defined in the second side of the body (10) under the connecting groove (13). The first groove (12) and the second groove (14) correspond to each other. A third groove (17) and a fourth groove (18) are longitudinally defined in a bottom of the body (10) and parallel to each other.

The clamping device for combined floors in accordance with the present invention is provided to connect the combined floors and connected to one after one. The clamping device is made of plastic and comprises a base member (20) that has a snapper (21) extending upwardly from the base member (20). The snapper (21) has an enlarged head (not numbered) formed on a free end of the snapper (21) and adapted to be received in the first groove (12) of the combined floor and the second groove (14) of the an adjacent combined floor. The base member (20) has a first rib (22) upwardly extending from the base member (20) near a first side of the base member (20) and a second rib (23) upwardly extending from the base member (20) near a second side of the base member (20). The first rib (22) of the base member (20) and the second rib (23) of an adjacent base member (20) are respectively adapted to be received in the third groove (17) and the fourth groove (18) of the body (10). A π-shaped bracket (24) laterally extends from the first side of the base member (20). The π-shaped bracket (24) has two bridges (not numbered) parallel to each other and connected to the base member (20). A top plate (not numbered) is integrally connected to the two bridges of the π-shaped bracket (24) and parallel to the first side of the base member (20). The top plate of the π-shaped bracket (24) includes two opposite ends each having a stub (241) perpendicularly extending from the top plate and directing to the first side of the base member (20). Each bridge of π-shaped bracket (24) has a wing plate (242) laterally extending to connect to a corresponding one of the stub (241). An L-shaped lever (243) extends from the first side of the base member (20) between the two bridges of the π-shaped bracket (24). The lever (243) has a first end integrally connected to the first side of the base member (20) and a second end upwardly extending relative to the first end of the lever (243). A recess (25) is defined in the base member (20) for movably receiving the top plate of the π-shaped bracket (24) of an adjacent clamping device. A channel (26) is centrally defined in a second side of the base member (20). The channel (26) extends to communicate with the recess (25) and movably receives the two bridges of the π-shaped bracket (24) of the adjacent clamping device. The channel (26) has a width narrower than that of the recess (25) so that two blocks (not numbered) are formed on two opposite ends of the second side of the base member (20). Each block has a bore (28) defined to receive a spring (29) in the block and extends to communicate with the recess (25). The stubs (241) of the π-shaped bracket (24) of the adjacent clamping device abut the springs (29) when the clamping devices are connected. A passage (281) is laterally defined in each block. The passage (281) is extends to communicate with the channel (26) and the bore (28). The passage (281) slidably receives the wing plate (242) of the π-shaped bracket (24) of the adjacent clamping device when the clamping devices are connected. A cutout (not numbered) is defined in each block and communicating with the passage (281) for forming a guiding portion (282) to guide the wing plate (242) into the passage (281).

Figure 5:
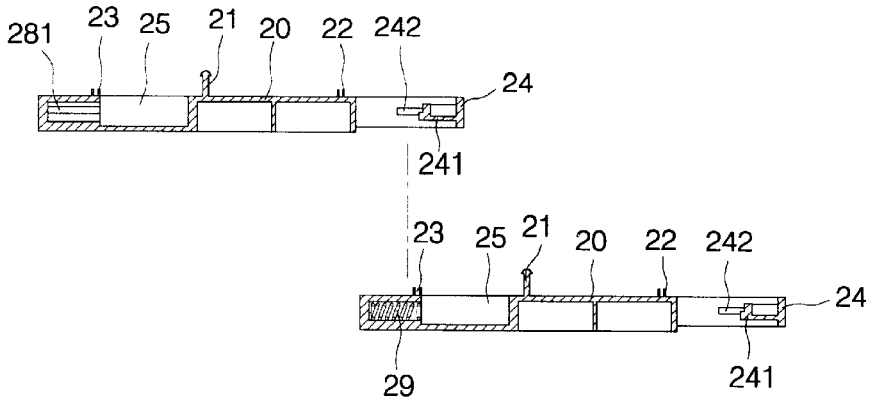
FIG. 5 is a side operational plan view in cross section of two clamping device for showing how the two clamping device connected to each other.
Figure 6:
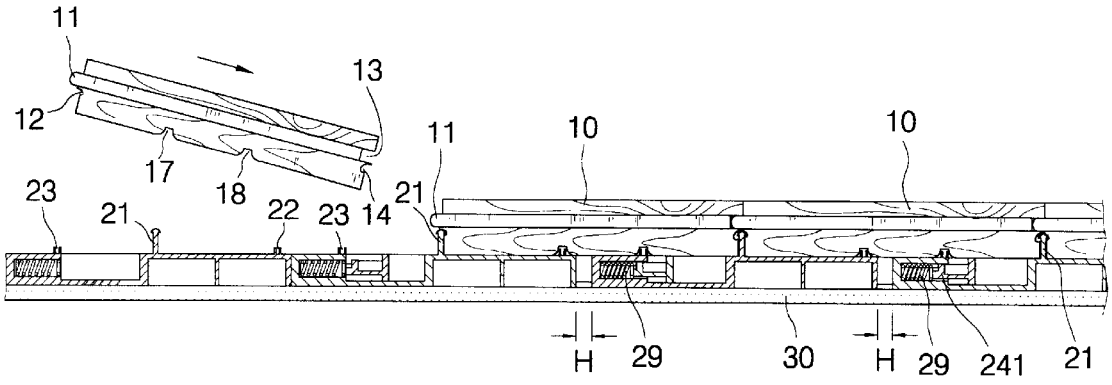
FIG. 6 is a side operational plan view in partial cross section for show how the combined floors connected to the clamping devices.

To operate the clamping device of the present invention, with reference to FIGS. 5 and 6, a cushion pad (30) is situated between the clamping devices and the original floor (not shown) for skidproof, noise elimination and absorbing shake. The stubs (241) is moved to press the spring (29) in the bore (28) in the adjacent clamping device and formed a gap (H) between every two adjacent clamping device when the combined floor is pressed to connect to the clamping devices then the first rib (22) and the second rib (23) of the adjacent clamping device are respectively adapted to be received in the third groove (17) and the fourth groove (18). The restitution force of the springs (29) can provide a good clamping effect to the combined floor and the springs (29) can absorb length variation of the combined floors due to the variation of temperature of environment. Furthermore, using the present invention to decorate your floor does not need any glue and nails it is a good design for easy construction. The user only needs to upwardly pull the lever (243) of the clamping device in accordance with the present invention then the clamping device is easily detached from one another for conveniently carry.

Although the invention has been explained in relation to its preferred embodiment, it is to be understood that many other possible modifications and variations can be made without departing from the spirit and scope of the invention as hereinafter claimed.

What is claimed is:

1. A clamping device for combined floors, the combined floors each having a rectangular body, a protrusion longitudinally and laterally extending from a first side of the body and a connecting groove longitudinally and laterally defined in a second side of the body, wherein the first side and the second side of the body are opposite to each other, a first groove longitudinally and laterally defined in the first side of the body under the protrusion, a second groove longitudinally and laterally defined in the second side of the body under the connecting groove, wherein the first groove and the second groove correspond to each other, a third groove and a fourth groove longitudinally defined in a bottom of the body and parallel to each other, the clamping device connected to an adjacent clamping device and comprising:

a base member including:

a snapper extending upwardly from the base member, the snapper having an enlarged head formed on a free end of the snapper and adapted to be received in the first groove of the combined floor and the second groove of the an adjacent combined floor;

a first rib upwardly extending from the base member near a first side of the base member;

a second rib upwardly extending from the base member near a second side of the base member;

a π-shaped bracket laterally extending from the first side of the base member, the π-shaped bracket having two bridges parallel to each other and connected to the base member, and a top plate integrally connected to the two bridges of the π-shaped bracket and parallel to the first side of the base member, the top plate of the π-shaped bracket including two opposite ends each having a stub perpendicularly extending from the top plate and directing to the first side of the base member, each bridge of π-shaped bracket having a wing plate laterally extending to connect to a corresponding one of the stub;

a recess defined in the base member for movably receiving the top plate of the π-shaped bracket of an adjacent clamping device;

a channel centrally defined in a second side of the base member, the channel extending to communicate with the recess and movably receiving the two bridges of the π-shaped bracket of the adjacent clamping device, the channel having a width narrower than that of the recess so that two blocks formed on two opposite ends of the second side of the base member;

a bore defined in each block to receive a spring in the block and extends to communicate with the recess;

a passage laterally defined in each block, the passage extending to communicate with the channel and the bore for slidably receiving the wing plate of the π-shaped bracket of the adjacent clamping device when the clamping devices are connected; and a cutout defined in each block and communicating with the passage for forming a guiding portion to guide the wing plate into the passage.

2. The clamping device for combined floors as claimed in claim 1, wherein the first rib of the base member and the second rib of an adjacent base member are respectively adapted to be received in the third groove and the fourth groove of the body.

3. The clamping device for combined floors as claimed in claim 1, wherein the base member further includes an L-shaped lever extending from the first side of the base member between the two bridges of the π-shaped bracket, the lever having a first end integrally connected to the first side of the base member and a second end upwardly extending relative to the first end of the lever.

* * * * *